US011633025B2

(12) United States Patent
Rayeski et al.

(10) Patent No.: US 11,633,025 B2
(45) Date of Patent: Apr. 25, 2023

(54) CARRYING CASE WITH STAND

(71) Applicant: Otter Products, LLC, Fort Collins, CO (US)

(72) Inventors: Jonathan B. Rayeski, Fort Collins, CO (US); Cameron D. Magness, Fort Collins, CO (US)

(73) Assignee: Otter Products, LLC

( * ) Notice: Subject to any disclaimer, the term of this patent is extended or adjusted under 35 U.S.C. 154(b) by 137 days.

(21) Appl. No.: 17/340,284

(22) Filed: Jun. 7, 2021

(65) Prior Publication Data

US 2021/0401140 A1 Dec. 30, 2021

Related U.S. Application Data

(60) Provisional application No. 63/044,376, filed on Jun. 26, 2020.

(51) Int. Cl.

| | |
|---|---|
| ***A45C 11/00*** | (2006.01) |
| ***A45C 13/10*** | (2006.01) |
| ***A45C 13/02*** | (2006.01) |

(52) U.S. Cl.

CPC ..... *A45C 11/00* (2013.01); *A45C 13/02* (2013.01); *A45C 13/103* (2013.01);
(Continued)

(58) Field of Classification Search

CPC . A45C 13/02; A45C 13/103; A45C 2011/002; A45C 2011/003; A45C 11/00; A45C 2013/025; A45C 2200/15
(Continued)

(56) References Cited

U.S. PATENT DOCUMENTS

| | | | |
|---|---|---|---|
| 3,023,885 | A | 3/1962 | Kindseth |
| 4,029,999 | A | 6/1977 | Neumann et al. |

(Continued)

FOREIGN PATENT DOCUMENTS

| | | |
|---|---|---|
| CN | 202488509 U | 10/2012 |
| KR | 200446444 | 10/2009 |

(Continued)

OTHER PUBLICATIONS outfityours.com (Top 5 Best Clear iPhone 5S and iPhone 5 Cases—Incase, Otterbox, Giffin, Moshi [retrieved from https://www.youtube.com/watch?v=rWYKJvsDHPw], YouTube.com [online], May 17, 2013 [retrieved Oct. 11, 2017}, 3 pages.

(Continued)

*Primary Examiner* — Chun Hoi Cheung

(57) ABSTRACT

A carrying case for use with a game controller and a smartphone includes a top portion, a bottom portion, a handle, and a stand. The top portion and the bottom portion have an opened position for accessing the internal storage volume and a closed position for storing the game controller in the internal storage volume. The handle is attached to at least one of the top portion and the bottom portion for carrying the carrying case. The stand is integrated into a top surface of the top portion of the carrying case. The stand has a stowed position in which the stand is substantially flat and is extendable up from the stowed position to a use position for holding the smartphone at a preferred viewing angle on the top surface of the carrying case.

16 Claims, 12 Drawing Sheets

(52) U.S. Cl.
CPC ... *A45C 2011/002* (2013.01); *A45C 2011/003* (2013.01); *A45C 2013/025* (2013.01); *A45C 2200/15* (2013.01)

(58) Field of Classification Search
USPC ... 206/320, 305, 45.24, 45.25, 45.26, 45.27, 206/45.2, 45.23; 248/441.1
See application file for complete search history.

(56) References Cited

U.S. PATENT DOCUMENTS 4,097,878 A 6/1978 Cramer
4,584,718 A 4/1986 Fuller
4,856,658 A 8/1989 Novak
4,925,146 A 5/1990 Hegarty
4,933,988 A 6/1990 Thibault
4,981,243 A 1/1991 Rogowski
5,025,921 A 6/1991 Gasparaitis et al.
5,123,044 A 6/1992 Tate
5,138,523 A 8/1992 Benck et al.
5,360,108 A 11/1994 Magia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
D365,927 S 1/1996 Cho
5,508,479 A 4/1996 Schooley
5,541,813 A 7/1996 Satoh et al.
5,671,120 A 9/1997 Kikinisi
5,808,865 A * 9/1998 Alves ..... G06F 1/1628 206/320
6,097,593 A 8/2000 Faranda et al.
6,115,248 A 9/2000 Canova et al.
6,151,206 A 11/2000 Kato et al.
6,283,299 B1 * 9/2001 Lee ..... G06F 1/1628 206/320
6,311,017 B1 10/2001 Mori
6,317,313 B1 11/2001 Mosgrove et al.
6,349,824 B1 2/2002 Yamada
6,375,009 B1 4/2002 Lee
6,445,577 B1 9/2002 Madsen et al.
6,456,487 B1 9/2002 Hetterick
6,490,155 B2 12/2002 Han et al.
6,545,862 B1 4/2003 Gettemy et al.
6,616,111 B1 9/2003 White
6,625,394 B2 9/2003 Smith et al.
6,626,362 B1 9/2003 Steiner et al.
6,701,159 B1 3/2004 Powell
6,762,935 B2 7/2004 Hidewasa
6,865,076 B2 3/2005 Lunsford
6,966,519 B2 11/2005 Salentine et al.
7,050,841 B1 5/2006 Onda
7,072,699 B2 7/2006 Eiden
D526,780 S 8/2006 Richardson et al.
7,145,767 B2 12/2006 Mache et al.
7,194,291 B2 3/2007 Peng
D542,524 S 5/2007 Richardson et al.
7,236,588 B2 6/2007 Gartrell
7,343,184 B2 3/2008 Rostami
7,359,184 B2 4/2008 Lord
D574,819 S 8/2008 Andre et al.
D581,155 S 11/2008 Richardson et al.
D581,421 S 11/2008 Richardson et al.
D587,008 S 2/2009 Richardson et al.
D589,016 S 3/2009 Richardson et al.
7,555,325 B2 6/2009 Goros
7,558,594 B2 7/2009 Wilson
7,688,580 B2 3/2010 Richardson et al.
7,845,608 B1 12/2010 Chen et al.
7,889,489 B2 2/2011 Richardson et al.
7,907,394 B2 3/2011 Richardson et al.
7,933,122 B2 4/2011 Richardson et al.
8,049,727 B2 11/2011 Hanson et al.
8,204,561 B2 6/2012 Mongan et al.
8,226,054 B2 7/2012 Chen et al.
8,442,604 B1 5/2013 Diebel
8,453,344 B2 6/2013 Nishiwaki et al.
8,457,701 B2 6/2013 Diebel
8,490,783 B1 7/2013 Fan
8,509,865 B1 8/2013 LaColla et al.
8,560,031 B2 10/2013 Barnett et al.
8,567,599 B2 10/2013 Beatty et al.
8,599,547 B2 12/2013 Richardson et al.
8,613,349 B1 * 12/2013 Halko ..... A45C 9/00 280/37
8,676,281 B1 3/2014 Caulder et al.
8,755,852 B2 6/2014 Hynecek et al.
8,777,002 B2 7/2014 Thomas et al.
8,798,675 B2 8/2014 Salmon et al.
8,800,762 B2 8/2014 Fathollahi
8,950,725 B2 2/2015 Huang et al.
8,965,458 B2 2/2015 Richardson et al.
9,008,738 B1 4/2015 Dong
9,060,580 B2 6/2015 Tages
9,086,842 B2 7/2015 Wen et al.
9,089,056 B2 7/2015 Rayner
9,098,238 B2 8/2015 Richardson et al.
9,125,297 B2 9/2015 Magness
9,136,897 B2 9/2015 Hynecek et al.
9,153,112 B1 10/2015 Kiani et al.
9,226,057 B1 12/2015 Davis et al.
9,266,664 B2 2/2016 Bau
9,274,556 B2 3/2016 Gallouzi et al.
9,295,174 B2 3/2016 Witter et al.
9,316,026 B2 4/2016 Myers et al.
9,367,090 B2 6/2016 Barnett et al.
9,377,154 B2 6/2016 Hung et al.
D762,258 S 7/2016 Jenkins
9,408,448 B2 8/2016 Kay et al.
D766,226 S 9/2016 Wu
D766,227 S 9/2016 Wu
D769,855 S 10/2016 Deng
9,462,099 B2 10/2016 Wilson et al.
9,481,490 B2 11/2016 Venida et al.
9,487,376 B2 11/2016 Salentine et al.
9,501,101 B2 * 11/2016 Daley, III ..... H05K 5/0226
9,503,147 B2 11/2016 Witter et al.
9,537,526 B2 1/2017 Wilson et al.
9,540,856 B2 1/2017 Lin
9,545,140 B1 1/2017 Johnson et al.
9,615,476 B2 4/2017 Rayner et al.
9,622,556 B2 4/2017 Fathollahi et al.
9,654,605 B2 5/2017 Goldfain et al.
9,660,684 B2 5/2017 Rayner
9,687,076 B2 6/2017 Su
9,743,540 B2 8/2017 Magness
9,774,713 B2 9/2017 Guerdrum et al.
9,788,620 B1 10/2017 Parkinson
9,807,211 B2 10/2017 Guerdrum et al.
9,851,758 B2 12/2017 Rowley
D808,376 S 1/2018 Kim
D808,377 S 1/2018 Witter et al.
9,854,897 B1 * 1/2018 Pelkey, Jr. ..... H01M 50/267
9,871,550 B2 1/2018 Witter et al.
9,946,301 B2 4/2018 Lan
D824,376 S 7/2018 Lee
10,027,783 B2 7/2018 Dukerschein et al.
10,058,155 B2 8/2018 Guerdrum et al.
D827,627 S 9/2018 Lee
D829,700 S 10/2018 Kim
10,103,769 B2 10/2018 Witter et al.
10,136,716 B2 11/2018 Northrup et al.
10,178,903 B2 1/2019 Guerdrum et al.
10,206,472 B1 2/2019 Northrup et al.
10,216,223 B2 2/2019 Hsu et al.
10,485,312 B2 11/2019 Rodriguez
2001/0054594 A1 12/2001 Maier-Hunke
2002/0065054 A1 5/2002 Humphreys et al.
2002/0079244 A1 6/2002 Kwong
2004/0134812 A1 * 7/2004 Yeh ..... G06F 1/163 206/320
2004/0150945 A1 8/2004 Mache et al.

(56) References Cited

U.S. PATENT DOCUMENTS

2005/0088811 A1 4/2005 Ulla et al.
2005/0213298 A1 9/2005 Doherty et al.
2005/0224508 A1 10/2005 Tajiri et al.
2005/0279661 A1 12/2005 Hodges
2006/0027718 A1 2/2006 Quijano et al.
2006/0066438 A1 3/2006 Altounian et al.
2006/0172765 A1 8/2006 Lev
2006/0237495 A1 10/2006 Chen et al.
2006/0243679 A1 11/2006 Dickerson
2006/0255493 A1 11/2006 Fouladpour
2007/0071423 A1 3/2007 Fantone et al.
2007/0115387 A1 5/2007 Ho
2007/0146985 A1 6/2007 Mick et al.
2007/0158220 A1 7/2007 Cleereman et al.
2007/0297149 A1 12/2007 Richardson et al.
2008/0117578 A1 5/2008 Moscovitch
2008/0163463 A1 7/2008 Hulden
2008/0304692 A1 12/2008 Zhang
2009/0001232 A1 1/2009 Seo et al.
2009/0034169 A1 2/2009 Richardson et al.
2009/0079665 A1 3/2009 Moscovitch
2009/0161903 A1 6/2009 White
2009/0237377 A1 9/2009 Lai et al.
2009/0283184 A1 11/2009 Han
2010/0006468 A1 1/2010 Lin
2010/0090085 A1 4/2010 Corrion
2010/0093412 A1 4/2010 Serra et al.
2010/0122756 A1 5/2010 Longinotti-Buitoni
2010/0141864 A1 6/2010 Lai
2010/0147737 A1 6/2010 Richardson et al.
2010/0195279 A1 8/2010 Michael
2010/0203931 A1 8/2010 Hynecek et al.
2010/0215188 A1 8/2010 Wilcox
2010/0230301 A1 9/2010 Fellig
2011/0064401 A1 3/2011 DeSorbo
2011/0075349 A1 3/2011 Ma et al.
2011/0170256 A1 7/2011 Lee
2011/0192857 A1 8/2011 Rothbaum et al.
2011/0216495 A1 9/2011 Marx
2011/0228459 A1 9/2011 Richardson et al.
2011/0235846 A1 9/2011 Jiang et al.
2011/0294556 A1 12/2011 Berg et al.
2012/0018325 A1 1/2012 Kim
2012/0031788 A1 2/2012 Mongan et al.
2012/0037524 A1 2/2012 Thomas et al.
2012/0037536 A1 2/2012 Thomas et al.
2012/0106069 A1 5/2012 Strauser
2012/0111881 A1 5/2012 Gaddis et al.
2012/0170194 A1 7/2012 Lord et al.
2012/0287565 A1 11/2012 Bennett
2012/0325607 A1* 12/2012 Webster ..... A45C 15/00 280/30
2013/0027862 A1 1/2013 Rayner
2013/0039521 A1 2/2013 Zhou et al.
2013/0083953 A1 4/2013 Chang
2013/0088813 A1 4/2013 Su et al.
2013/0098788 A1 4/2013 McCarville et al.
2013/0107449 A1 5/2013 Su et al.
2013/0109253 A1 5/2013 Gammon et al.
2013/0117487 A1 5/2013 Leung
2013/0126533 A1 5/2013 Klosky
2013/0175186 A1 7/2013 Simmer
2013/0177181 A1 7/2013 Marcus
2013/0220841 A1 8/2013 Yang
2013/0220847 A1 8/2013 Fisher et al.
2013/0222989 A1 8/2013 Chen
2013/0230202 A1 9/2013 Widner et al.
2013/0240578 A1 9/2013 Yu
2013/0262248 A1 10/2013 Kim et al.
2013/0292269 A1 11/2013 Tages
2013/0292288 A1 11/2013 Willes
2014/0003647 A1 1/2014 Liu
2014/0049142 A1 2/2014 Magness
2014/0065847 A1 3/2014 Salmon et al.
2014/0080553 A1 3/2014 Forset et al.
2014/0097102 A1 4/2014 Piatt et al.
2014/0099526 A1 4/2014 Powell et al.
2014/0128132 A1 5/2014 Cox, I
2014/0141838 A1 5/2014 Cai et al.
2014/0152890 A1 6/2014 Rayner
2014/0166707 A1 6/2014 Leisey-Bartsch
2014/0168884 A1 6/2014 Wylie
2014/0183064 A1 7/2014 Ge
2014/0183065 A1 7/2014 Toulotte
2014/0187289 A1 7/2014 Cataldo et al.
2014/0200056 A1 7/2014 Liu
2014/0227026 A1 8/2014 O'Neill et al.
2014/0228074 A1 8/2014 Kulkarni et al.
2014/0262848 A1 9/2014 Fathollahi et al.
2014/0262934 A1 9/2014 Fathollahi et al.
2014/0265765 A1 9/2014 Khodapanah et al.
2014/0265767 A1 9/2014 Fathollahi
2014/0299488 A1 10/2014 Andrew
2014/0302896 A1 10/2014 Xu et al.
2014/0332418 A1* 11/2014 Cheung ..... H04B 1/3877 206/45.2
2015/0061477 A1 3/2015 Wilson
2015/0062787 A1 3/2015 Wilson et al.
2015/0068935 A1 3/2015 Kay et al.
2015/0083615 A1 3/2015 Lay et al.
2015/0111623 A1 4/2015 Hegemier et al.
2015/0133183 A1 5/2015 Alameh et al.
2015/0141090 A1 5/2015 Hwan et al.
2015/0141095 A1 5/2015 Kim
2015/0172431 A1 6/2015 Huang
2015/0189160 A1 7/2015 Auger et al.
2015/0194997 A1 7/2015 Johnson et al.
2015/0194998 A1 7/2015 Fathollahi
2015/0195938 A1 7/2015 Witter et al.
2015/0201723 A1 7/2015 Rayner et al.
2015/0214989 A1 7/2015 Yeh et al.
2015/0220766 A1 8/2015 Russell et al.
2015/0257285 A1 9/2015 Wilson et al.
2015/0257287 A1 9/2015 Tages
2015/0304466 A1 10/2015 Tamatsu
2016/0007705 A1 1/2016 Liebers et al.
2016/0036478 A1 2/2016 Wong
2016/0072933 A1 3/2016 Cox, I
2016/0080024 A1 3/2016 Wilson et al.
2016/0088750 A1* 3/2016 Wu ..... H05K 5/0086 248/688
2016/0090767 A1 3/2016 Park et al.
2016/0113368 A1* 4/2016 Tu ..... A45C 11/00 206/45.23
2016/0122821 A1 5/2016 Liu et al.
2016/0142093 A1 5/2016 Phang
2016/0164565 A1 6/2016 Witter et al.
2016/0173670 A1 6/2016 Langhein
2016/0179143 A1 6/2016 Bidwell et al.
2016/0183392 A1 6/2016 Kelley
2016/0195898 A1 7/2016 Lau
2016/0198822 A1 7/2016 Lee et al.
2016/0254836 A1 9/2016 Alsberg et al.
2016/0261133 A1 9/2016 Wang
2016/0282905 A1 9/2016 Laine et al.
2016/0286920 A1 10/2016 Lean et al.
2016/0286921 A1 10/2016 Northrup et al.
2016/0295981 A1 10/2016 Lay et al.
2017/0026498 A1 1/2017 Goldfain et al.
2017/0041037 A1 2/2017 Witter et al.
2017/0099922 A1 4/2017 Guerdrum et al.
2017/0099924 A1 4/2017 Fathollahi et al.
2017/0119120 A1 5/2017 Richardson et al.
2017/0237460 A1 8/2017 Rayner
2017/0279478 A1 9/2017 Fathollahi
2017/0327054 A1 11/2017 Yu et al.
2017/0328517 A1 11/2017 Wessels
2017/0353208 A1 12/2017 Wilson et al.
2017/0359096 A1 12/2017 Witter et al.
2017/0360200 A1 12/2017 Cohen
2018/0136695 A1 5/2018 Lo et al.
2018/0167498 A1 6/2018 Drakos
2018/0369599 A1 12/2018 Smith
2019/0094853 A1 3/2019 Overall

(56) References Cited

U.S. PATENT DOCUMENTS

| | | | |
|---|---|---|---|
| 2019/0141848 | A1 | 5/2019 | Sung |
| 2019/0212774 | A1 | 7/2019 | Patterson et al. |
| 2019/0222682 | A1 | 7/2019 | Ren et al. |
| 2019/0250664 | A1 | 8/2019 | Eslava et al. |
| 2019/0281147 | A1 | 9/2019 | Sherburne et al. |
| 2019/0286191 | A1 | 9/2019 | Correll, Jr. |
| 2020/0200322 | A1 | 6/2020 | Mareks, Jr. et al. |

FOREIGN PATENT DOCUMENTS

| | | | |
|---|---|---|---|
| KR | 101394285 | | 5/2014 |
| WO | 1994000037 | A1 | 1/1994 |
| WO | 1999041958 | A1 | 8/1999 |
| WO | 2015103599 | A1 | 7/2015 |

OTHER PUBLICATIONS

Randomrazr (New Otterbox Symmetry Case—The Slim Protective Case for the iPhone 5S/5C [retrieved from https://wwwyoutube.com/watch?v=zGWZTGamuT0], YouTube.com [online], Mar. 30, 2014 [retrieved Oct. 11, 2017]), 5 pages.

* cited by examiner

CARRYING CASE WITH STAND

CROSS-REFERENCE TO RELATED APPLICATIONS

The present application claims priority to U.S. Provisional Patent Application No. 63/044,376, filed Jun. 26, 2020, which is hereby incorporated by reference in its entirety.

BACKGROUND

Electronic gaming has become more popular in recent years. Players typically prefer using their own game controller, even if they are traveling or playing on a different system. For this reason, it has become more common for players to take their game controllers with them to different locations. In addition, these game controllers are sometimes used to play games on personal and/or portable electronic devices. Examples of personal electronic devices include smartphones, tablet computers, gaming devices, laptop computers, video players, and/or other portable display devices. Improved carrying cases which accommodate use of portable electronic devices are desired.

DETAILED DESCRIPTION

Electronic gaming has become more popular in recent years. Players often prefer using their own game controller even if they are playing at a different location, on a different system, or in a mobile environment. For this reason, it has become more common for players to take their game controllers with them to different locations. In addition, these game controllers are sometimes used to play games on personal and/or portable electronic devices. Examples of personal electronic devices include smartphones, tablet computers, gaming devices, laptop computers, video players, and/or other portable display devices. Improved carrying cases for game controllers are desired, including carrying cases which facilitate game play on portable electronic devices.

While most of the examples discussed herein are explained with respect to a game controller, the apparatuses and techniques disclosed herein are not limited to specific types of game controllers and may be used with any type of input, peripheral, or accessory device that may be used with a portable electronic device. Further, while most of the examples discussed herein are also explained with respect to a smartphone, the apparatuses and techniques disclosed herein are not limited to smartphones and may be used with any processing or display device.

In one example, a carrying case for use with a game controller and a smartphone includes a top portion, a bottom portion, a handle, and a stand. The top portion engages the bottom portion to form an internal storage volume configured for receiving the game controller. The top portion and the bottom portion have an opened position for accessing the internal storage volume and a closed position for storing the game controller in the internal storage volume. The handle is attached to at least one of the top portion and the bottom portion for carrying the carrying case. The stand is integrated into a top surface of the top portion of the carrying case. The stand has a stowed position in which the stand is substantially flat and is extendable up from the stowed position to a use position for holding the smartphone at a preferred viewing angle on the top surface of the carrying case.

Figure 1:
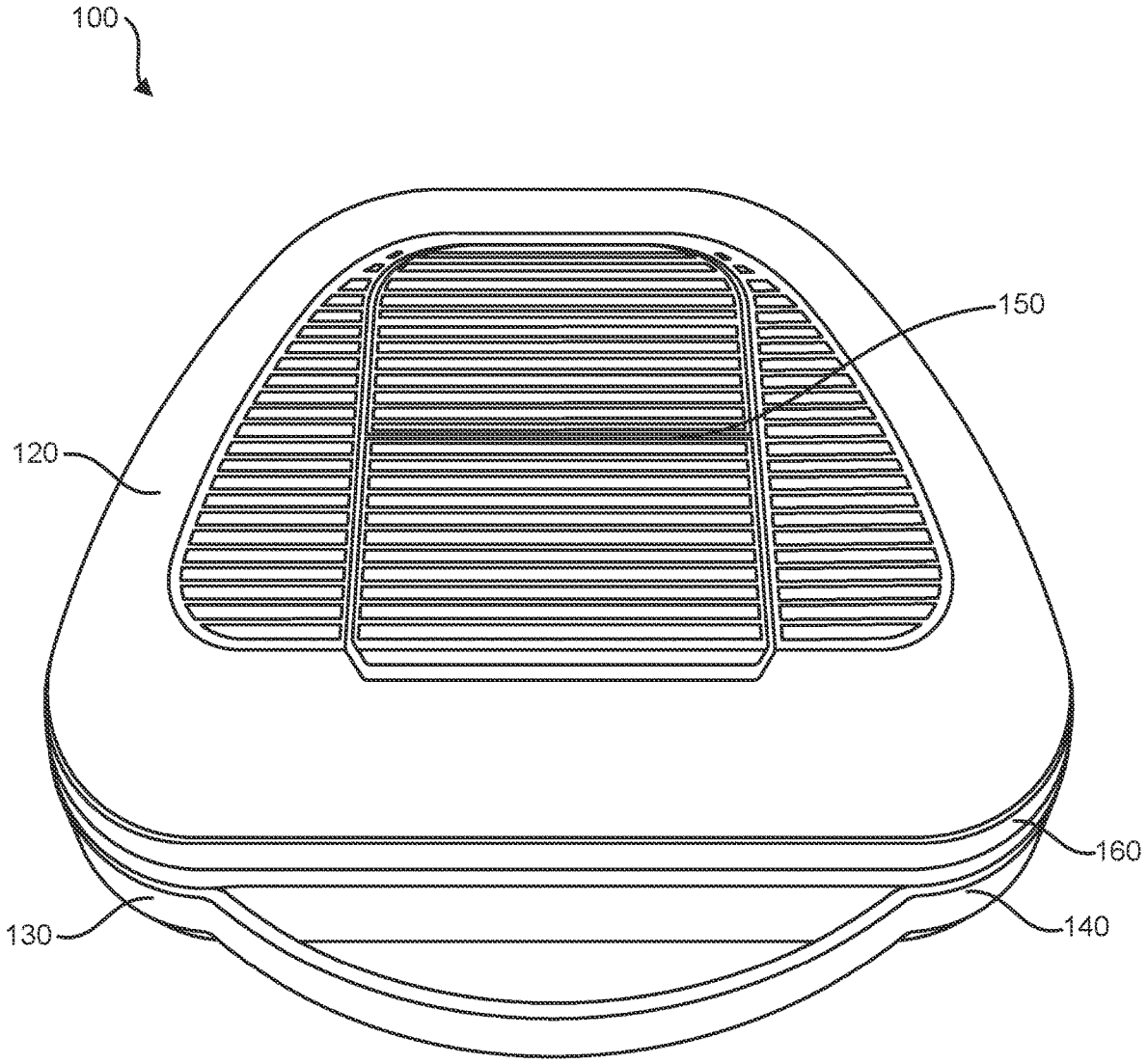
FIG. 1 illustrates a carrying case having a stand.
Figure 2:
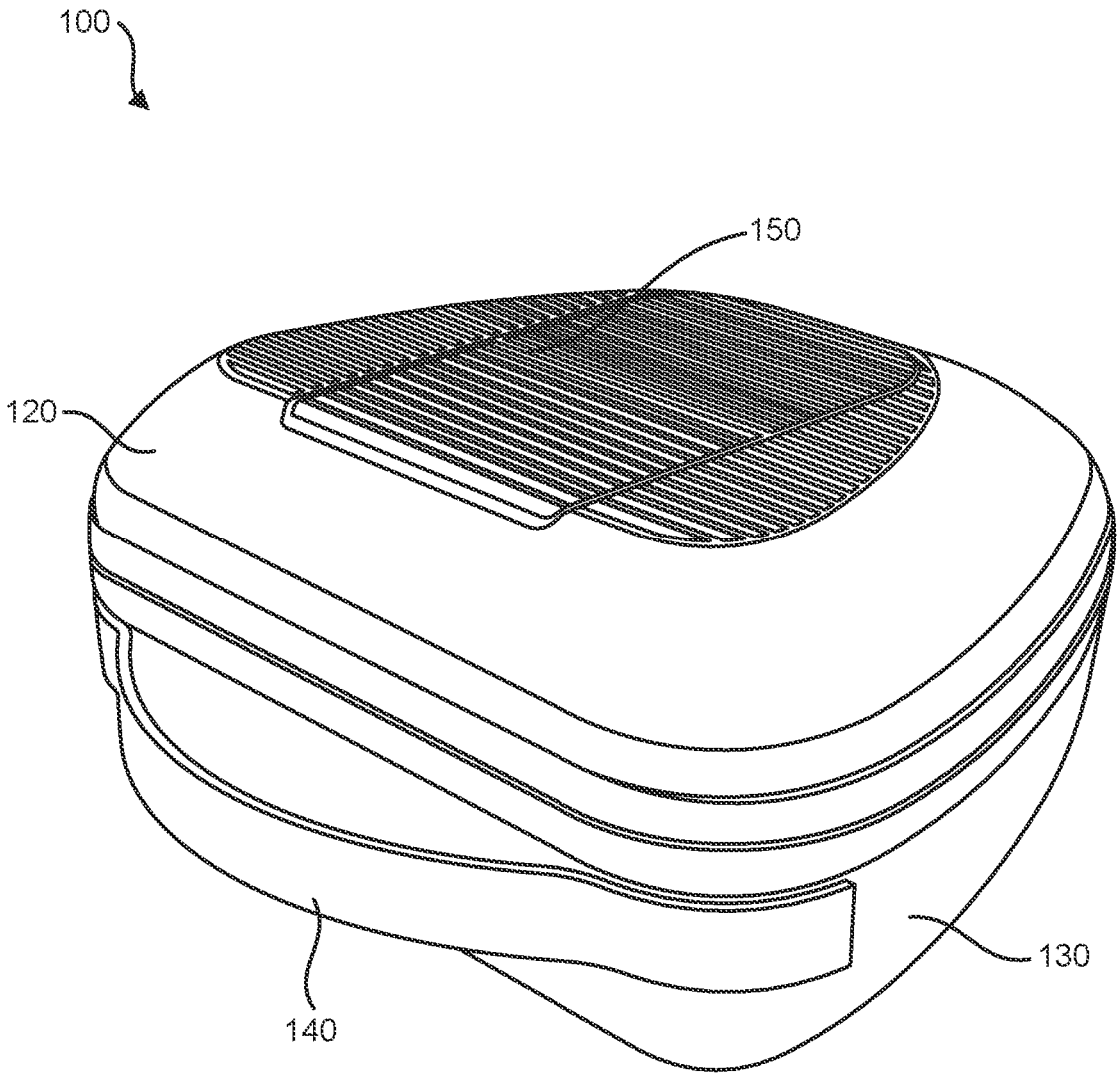
FIG. 2 illustrates a perspective view of the carrying case of FIG. 1.

FIG. 1 illustrates a carrying case 100 for a game controller. Carrying case 100 includes a top portion 120, a bottom portion 130, a handle 140, a stand 150, and a zipper 160. These elements are each discussed in further detail in the description below. FIG. 2 illustrates a perspective view of carrying case 100 in the closed position.

Figure 3:
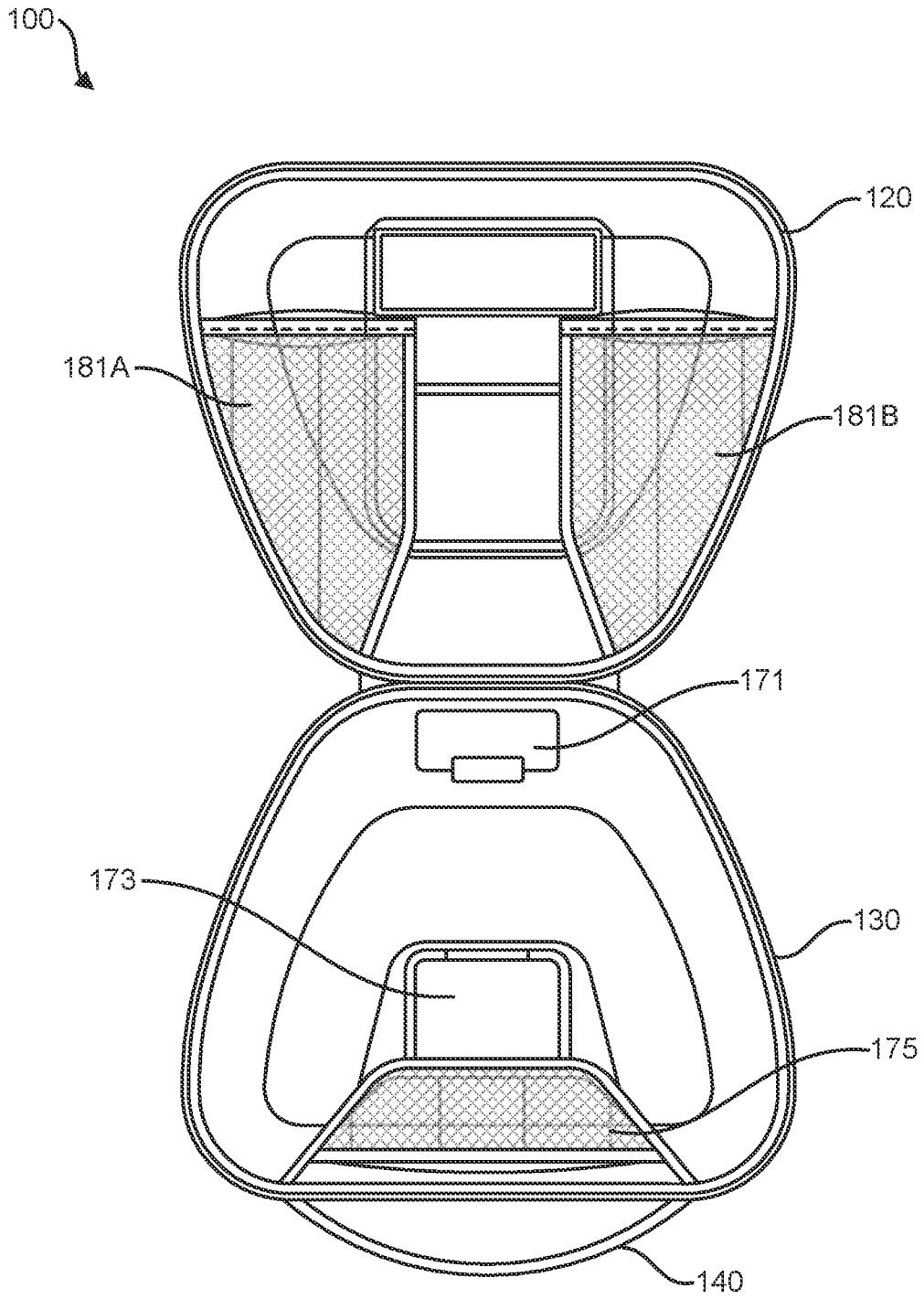
FIG. 3 illustrates internal features of the carrying case of FIG. 1.

FIG. 3 illustrates an interior of carrying case 100 in the opened position. Top portion 120 and bottom portion 130 may remain at least partially attached when carrying case is in the opened position as illustrated in FIG. 3 or they may detach from each other entirely. The interior of carrying case 100 may contain one or more pockets, such as pocket 181A, 181B, battery pocket 173, and/or pocket 175 for cables, batteries, accessories, or other items. The pockets may utilize netting, elastic, zippers, covers, doors, and/or hook and loop fasteners. Carrying case 100 may also include a pocket or compartment for storing a smartphone.

The interior of carrying case 100 may include cushioning for protection and shock absorption and may be contoured or shaped to fit a particular game controller. In some examples, some or all of the cushioning may be removable or replaceable with different cushioning configured for fitting a different game controller.

Carrying case 100 may also contain one or more openings, apertures, or ports for routing a cable, such as a charging cable, between an exterior of carrying case 100 and the interior. A cable may be attached to the controller even though the controller is stored in carrying case 100 and carrying case 100 is otherwise closed. In some examples, the opening, aperture, or port may have a door or cover, such as charge port cover 171, that closes the opening when it is not in use. In some examples, it may close or open from inside the storage cavity.

Figure 4:
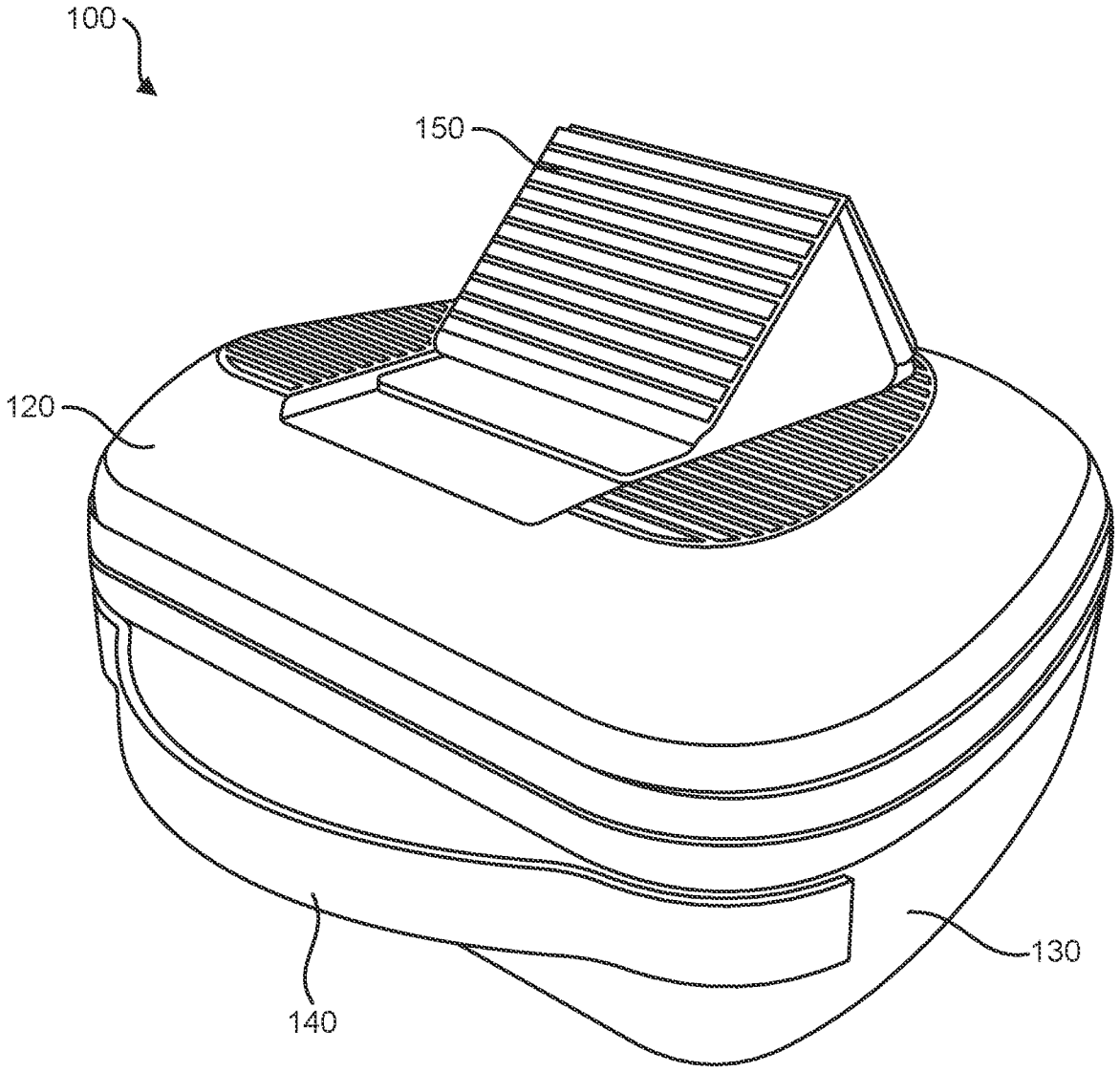
FIG. 4 illustrates the carrying case of FIG. 1 with the stand in a use position.
Figure 5:
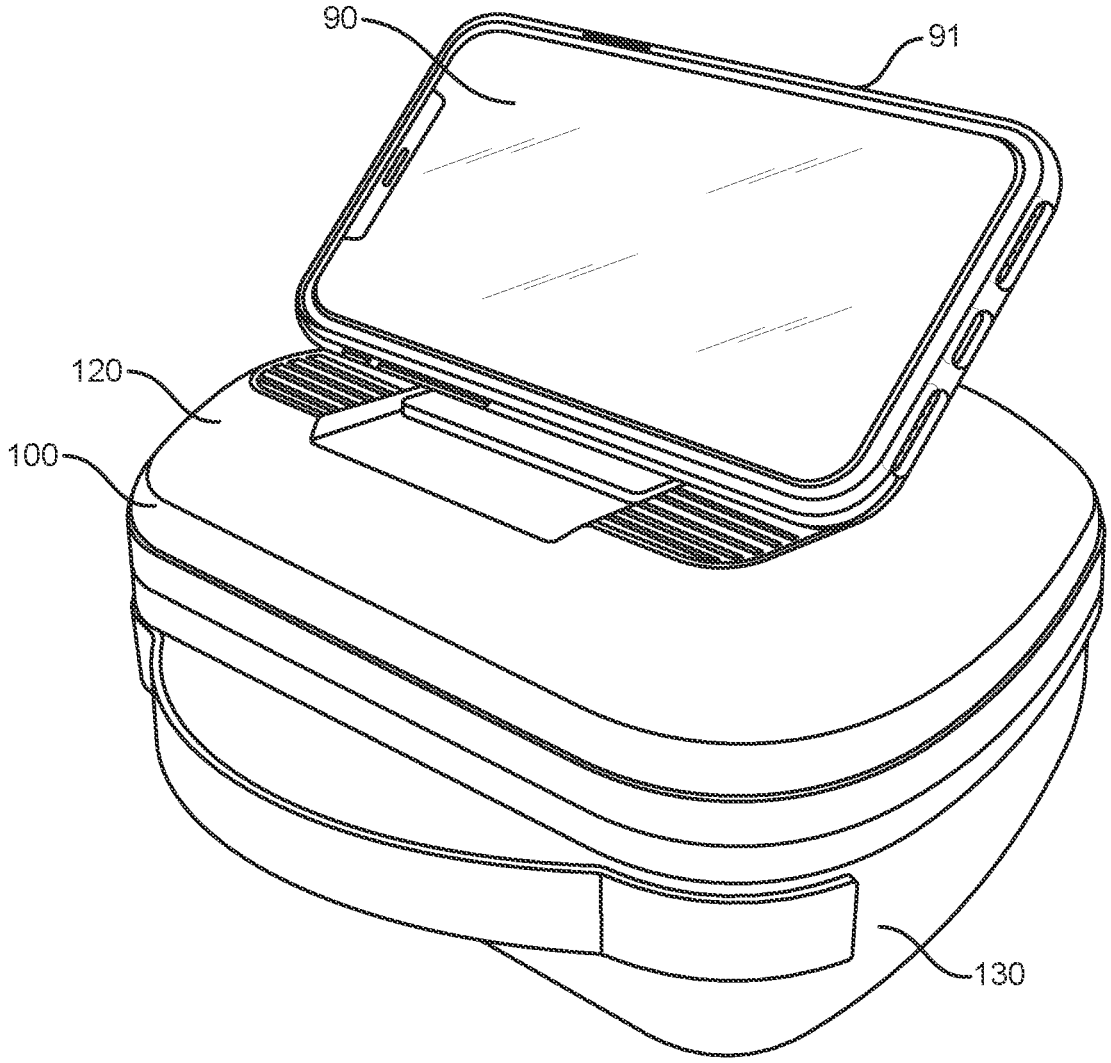
FIG. 5 illustrates the configuration of FIG. 4 with a smartphone.

FIG. 4 illustrates carrying case 100 with stand 150 in a use position or configuration. As illustrated in FIG. 5, the configuration of FIG. 4 enables a smartphone 90 to be placed on stand 150 such that it remains at a preferred viewing angle without being held. In the example of FIG. 5, smartphone 90 is in a protective case 91, but this is not necessary. In this configuration, a player may use the game controller to play a game that is conveniently viewed on smartphone 90. In this way, a user who has carrying case 100 always has a convenient stand available that holds smartphone 90 at a viewing angle and raised from a table or surface level. In one example, the viewing angle is between 30 and 80 degrees relative to the top surface of carrying case 100. In another example, the viewing angle is between 20 and 70 degrees relative to the top surface of carrying case 100. In another example, the viewing angle is between 40 and 60 degrees relative to the top surface of carrying case 100.

Figure 6:
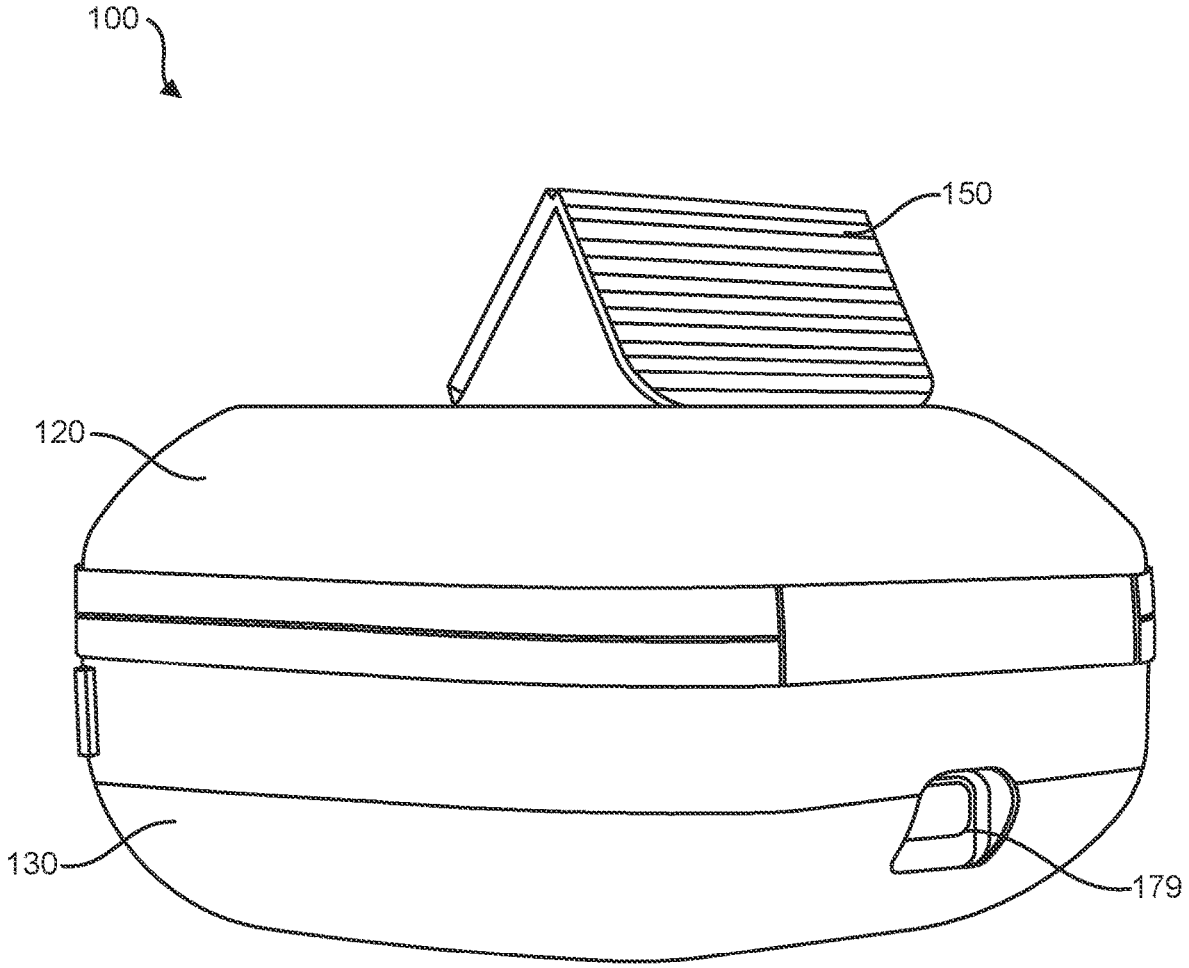
FIG. 6 illustrates a back view of the configuration of FIG. 4.
Figure 7:
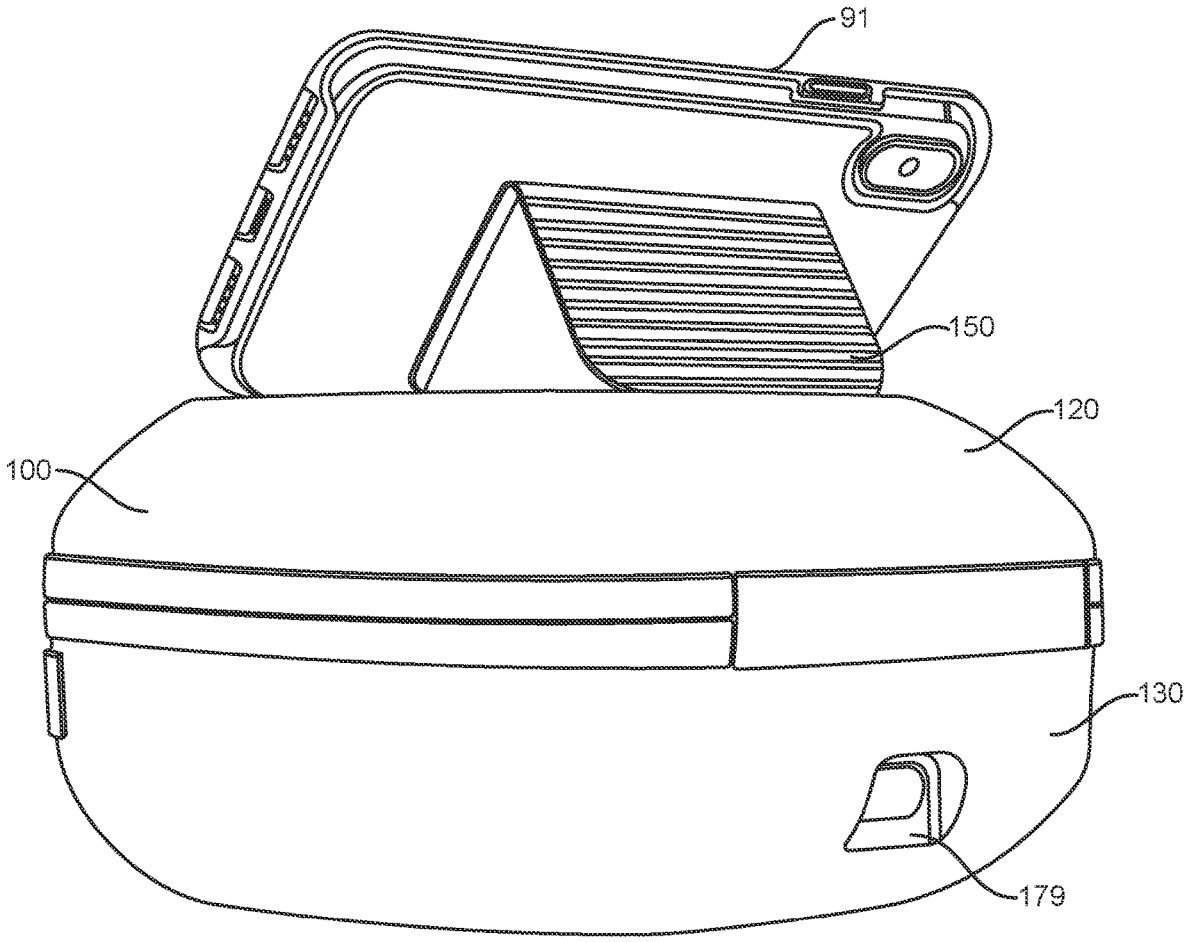
FIG. 7 illustrates a back view of the configuration of FIG. 5.
Figure 8:
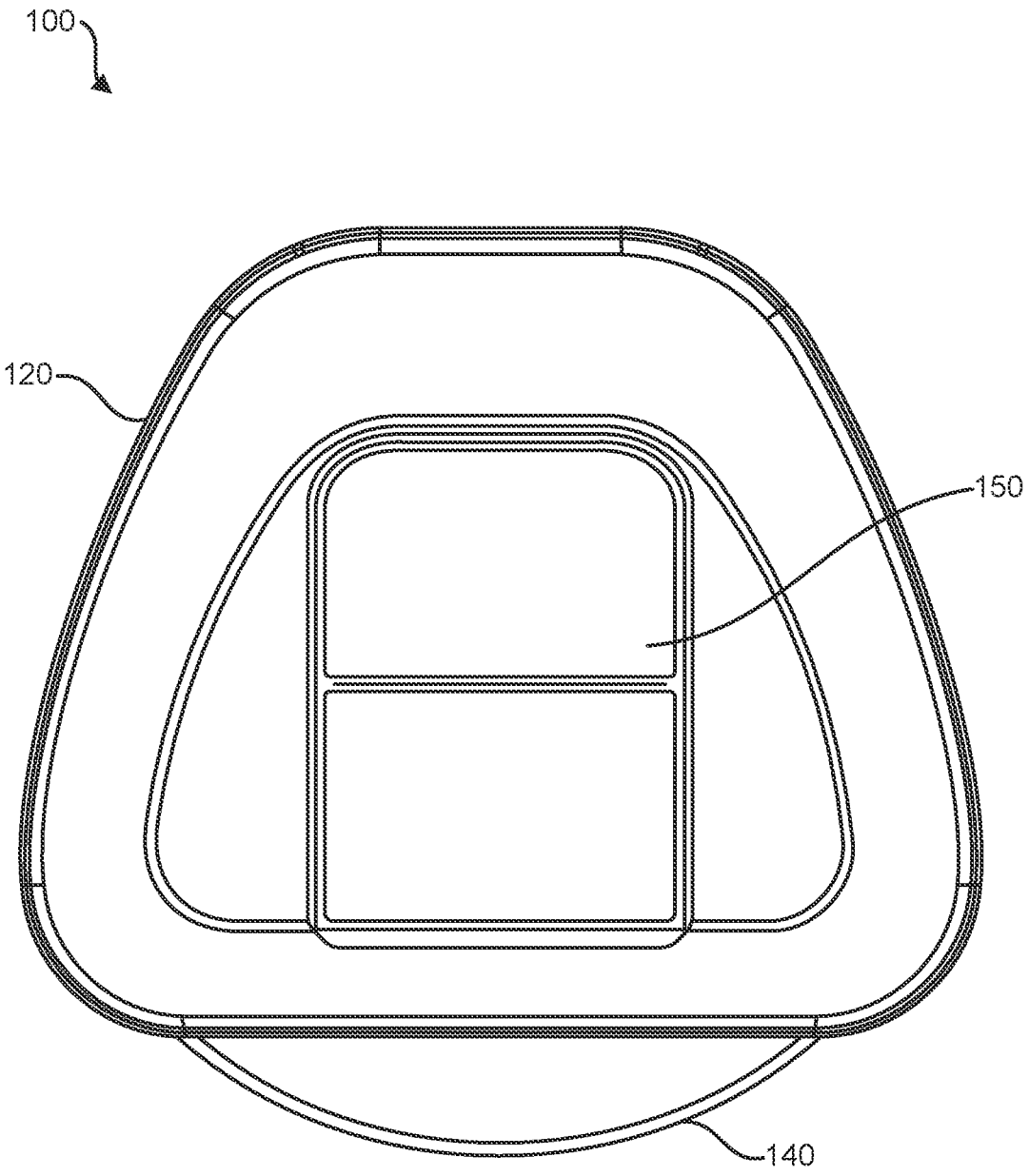
FIG. 8 illustrates a top view of the carrying case of FIG. 1.

FIG. 6 illustrates a rear view of carrying case 100 with stand 150 in the use position. Charge port 179 provides an opening, port, or aperture for routing a cable to a device inside carrying case 100 even when carrying case 100 is in the closed position. FIG. 7 illustrates a rear view of carrying case 100 with stand 150 in the use position with the smartphone in protective case 91 on stand 150. FIG. 8 illustrates a top view of carrying case 100 with stand 150 in the stowed position or configuration.

Figure 9:
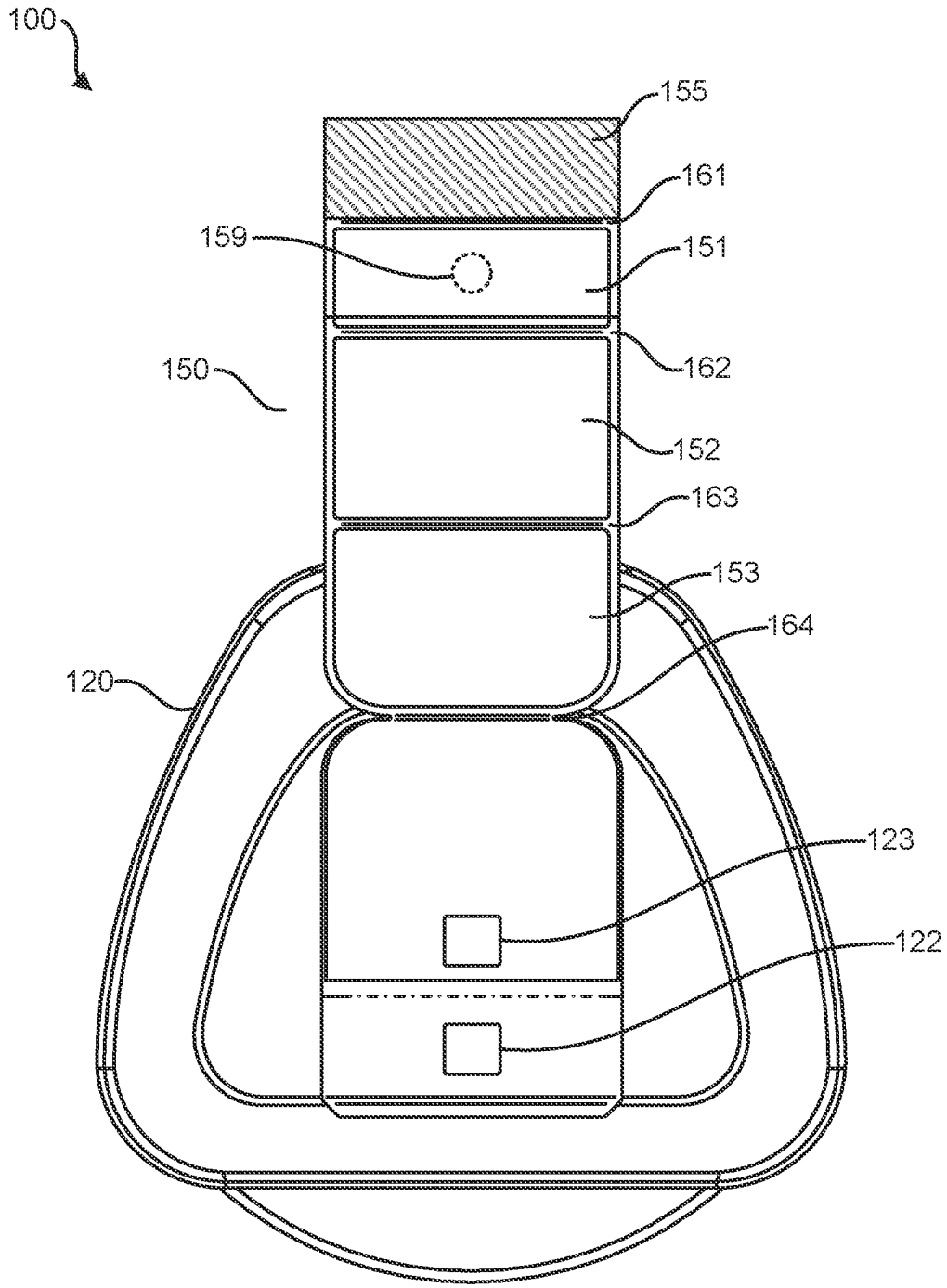
FIG. 9 illustrates the elements of the stand of FIG. 1.

FIG. 9 illustrates carrying case 100 with stand 150 fully unfolded in order to describe the elements of stand 150. It should be understood that the configuration illustrated in FIG. 9 may not be a configuration which is possible after carrying case 100 has been fully assembled and made available to an end user. However, the configuration of FIG. 9 facilitates explanation of the various elements of stand 150.

Stand 150 includes multiple panels which are connected to each other with flexible links, hinges, or living hinges. Specifically, stand 150 includes a first rigid panel 151, a second rigid panel 152, and a third rigid panel 153. First rigid panel 151 is connected to an attachment panel 155 through a first flexible link 161. Similarly, first rigid panel 151 is also attached to second rigid panel 152 on an opposite edge with second flexible link 162. Similarly, second rigid panel 152 is also attached to third rigid panel 153 on an opposite edge with third flexible link 163. Finally, third rigid panel 153 is also connected to top portion 120 of carrying case 120 with a fourth flexible link 164. In one variation, third rigid panel 153 may be attached to another panel through fourth flexible link 164, where this other panel is attached to top portion 120. Any of the flexible links may include any type of flexible material, hinge, and/or living hinge which allows the attached panels or items to move, pivot, or rotate relative to each other while remaining attached.

Figure 10:
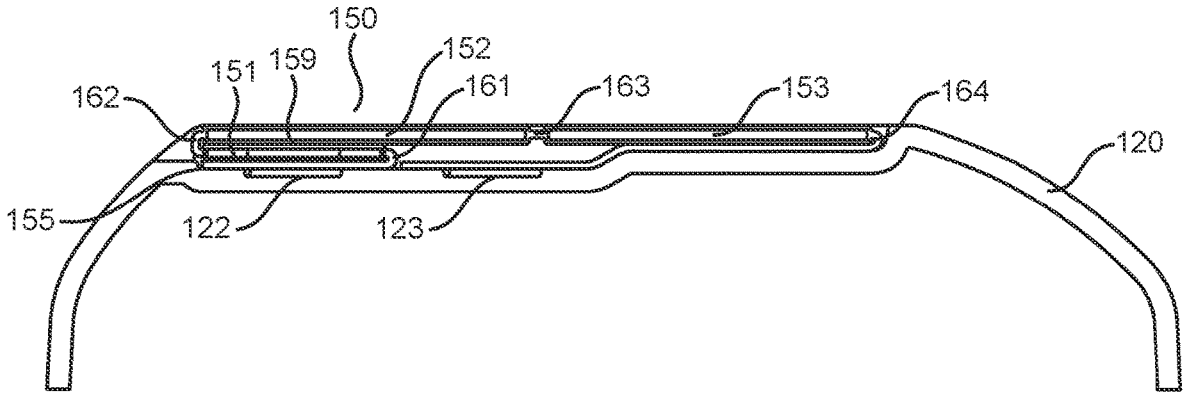
FIG. 10 illustrates a side cross-sectional view of the top portion of the carrying case of FIG. 1 with the stand in the stowed position.
Figure 11:
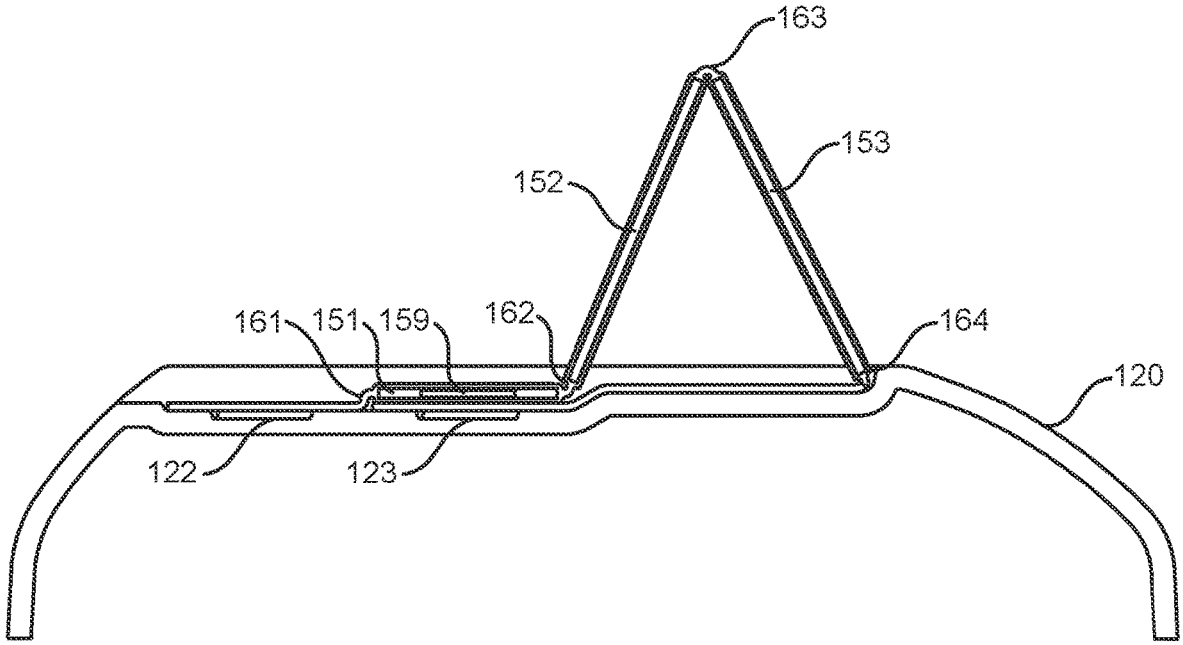
FIG. 11 illustrates a side cross-sectional view of the top portion of the carrying case of FIG. 1 with the stand in the use position.

Top portion 120 includes a first metallic plate 122 and a second metallic plate 123. The metallic plates may be on a surface of top portion 120 or embedded and under the top surface. First rigid panel 151 includes a magnet 159. When assembly is completed, attachment panel 155 is attached, affixed, glued, or welded at or over the region of top portion 120 that includes first metallic plate 122. FIGS. 10 and 11 illustrate the apparatus after this assembly step has been completed. Any of the elements described herein as rigid may also be partially rigid or semi-rigid.

FIG. 10 illustrates a side cross-sectional view of top portion 120 of carrying case 100 with stand 150 in the stowed position. The cross-section view cuts through stand 150. As discussed with respect to FIG. 9, attachment panel 155 is attached to top portion 120 in an area over or near first metallic plate 122. First rigid panel 151 is rotated or flipped approximately 180 degrees such that it is sitting on top of attachment panel 155. This movement is enabled and limited by first flexible link 161. Magnet 159 of first rigid panel 151 aligns with and is magnetically attracted to first metallic plate 122. This tends to keep first rigid panel 151 in this position until sufficient external force is applied to overcome the magnetic force.

Continuing with FIG. 10, second rigid panel 152 is rotated or flipped approximately 180 degrees such that it is sitting on top of first rigid panel 151. This movement is enabled and limited by second flexible link 162. Second rigid panel 152 also remains attached to third rigid panel 153 through third flexible link 163. Third rigid panel 153 remains attached to top portion 120 (or to another element that is attached to top portion 120) through fourth flexible link 164. However, the sizes of the rigid panels and the locations of the attachment points are such that second rigid panel 152 and third rigid panel 153 are extended to a flat configuration and in substantially a same plane when first rigid panel 151 is in the configuration illustrated in FIG. 10. This results in magnet 159 indirectly holding second rigid panel 152 and third rigid panel 153 in the substantially flat, stowed position on top of top portion 120. As illustrated in FIG. 10, top portion 120 may have a recessed area where stand 150 is attached such that the elements of stand 150 are flush, or substantially flush, with the remainder of the top surface of top portion 120 when the stand is in the stowed position.

FIG. 11 illustrates a side cross-sectional view of top portion 120 of carrying case 100 with stand 150 in the use or upright position or configuration. To achieve this configuration relative to FIG. 10, first rigid panel 151 has been flipped, pivoted, or rotated approximately 180 degrees. This movement forces second rigid panel 152 toward third rigid panel 153. Since the panels are flexibly attached to each other and since third rigid panel 153 is attached to top portion 120 at fourth flexible link 164, second rigid panel 152 and third rigid panel 153 are forced into the position illustrated in FIG. 11 to form the stand configuration (also illustrated in FIGS. 4-7). In this configuration magnet 159 is magnetically attracted to metallic plate 123 and tends to keep stand 150 in this position until a sufficient external force is applied to overcome the magnetic attraction.

In some examples, any portion of stand 150 and/or top portion 120 may include a surface having tacky, grippy, sticky, or friction enhancing characteristics for purposes of keeping the smartphone in the viewing position and reducing chances that it slips from that position.

In one example, metallic plate 122 and/or 123 may also be magnets. In a further variation of this example, magnet 159 may be a metallic plate that is attracted by magnets 122 and 123.

Figure 12:
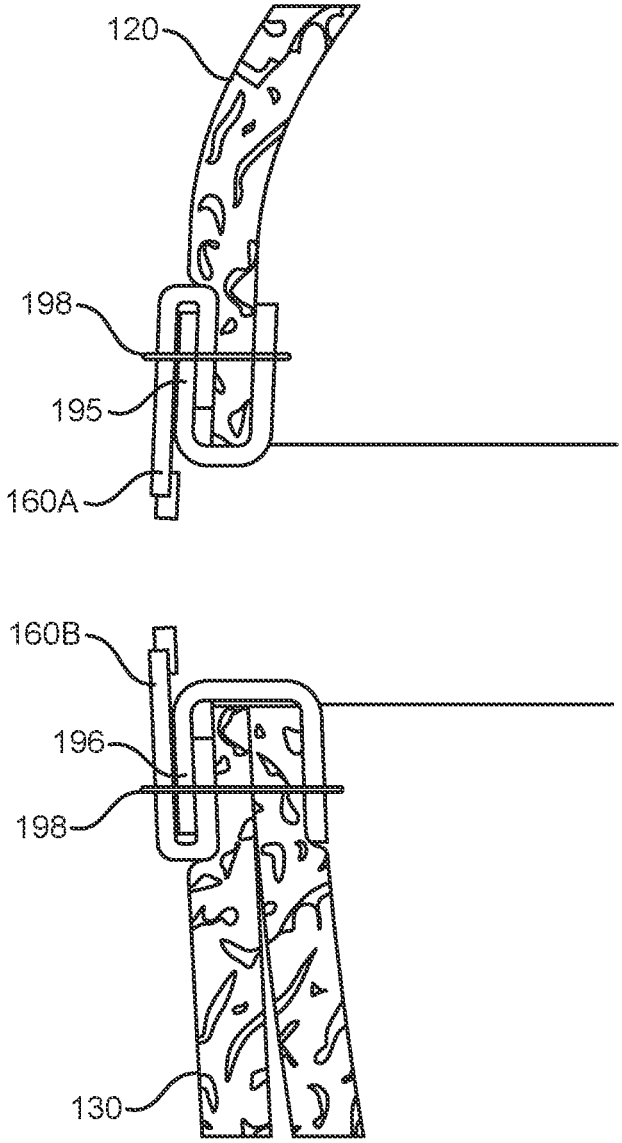
FIG. 12 illustrates a side cross-sectional view of the zipper mechanism of the carrying case of FIG. 1.

FIG. 12 illustrates a cross-sectional view of a portion of carrying case 100 that includes zipper 160 having a first zipper portion 160A and a second zipper portion 160B. First zipper portion 160A and second zipper portion 160B are attached to top portion 120 and bottom portion 130, respectively, with edge binding 195 and 196, respectively. The assemblies are held together with stitching 198. Carrying case 100 may be water-resistant or waterproof and zipper 160 may also be water-resistant or waterproof.

In some examples, any of the components described herein may be swapped or switch out for replacements of other sizes or configurations in order to accommodate a smartphone, computer, or game controller of another size or shape.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A carrying case for use with a game controller and a smartphone, the carrying case comprising:

a top portion;

a bottom portion configured to engage the top portion to form an internal storage volume configured for receiving the game controller, wherein the top portion and the bottom portion have an opened position for accessing the internal storage volume and a closed position for closing the internal storage volume and storing the game controller in the internal storage volume;

a handle attached to at least one of the top portion and the bottom portion, the handle configured for carrying the carrying case; and a stand integrated into a top surface of the top portion, wherein the stand has a stowed position in which the stand is flat on the top surface, wherein the stand is selectively extendable up from the stowed position to a use position configured for holding the smartphone on the top surface of the top portion at a preferred viewing angle relative to the top surface of the top portion of the carrying case, wherein the stand comprises three hingedly attached rigid panels, wherein the first rigid panel is attached to a first edge of the second rigid panel with a first living hinge and the third rigid panel is attached to a second edge of the second rigid panel with a second living hinge, wherein the first edge is opposite the second edge, and wherein the first rigid panel is hingedly attached to the top portion of the carrying case and the third rigid panel is also hingedly attached to the top portion of the carrying case.

2. The carrying case of claim 1 wherein the bottom portion includes a charge port opening for routing a charging cable from outside the carrying case through a wall of the bottom portion to the internal storage volume.

3. The carrying case of claim 2 wherein the bottom portion further includes a charge port door accessible from the internal storage volume for selectively accessing or closing the charge port opening from the internal storage volume.

4. The carrying case of claim 1 wherein the stand is configured to be temporarily and magnetically retained in each of the stowed position and the use position, alternately.

5. The carrying case of claim 4 wherein the stand includes a magnet and the top portion includes a first metallic plate and a second metallic plate, and wherein the magnet is configured to attract the first metallic plate to hold the stand in the stowed position and configured to attract the second metallic plate to hold the stand in the use position.

6. The carrying case of claim 4 wherein the stand includes a metallic plate and the top portion includes a first magnet and a second magnet, and wherein the metallic plate is configured to be attracted by the first magnet to hold the stand in the stowed position and configured to be attracted by the second magnet to hold the stand in the use position.

7. The carrying case of claim 1 wherein, in the stowed position, the second rigid panel and the third rigid panel are in a first plane and the first rigid panel is folded under the second rigid panel in a second plane that is parallel to the first plane.

8. The carrying case of claim 1 wherein the first rigid panel is configured to pivot approximately 180 degrees to transition the stand from the stowed position to the use position, wherein the second rigid panel and the third rigid panel form a triangular structure with the top portion of the carrying case when in the use position.

9. The carrying case of claim 1 wherein the top portion is attached to the bottom portion with a zipper.

10. A carrying case adapted for use with a gaming controller and a smartphone, the carrying case comprising:

a body having an internal storage volume adapted for receiving the gaming controller, wherein the body has an opened position for accessing the internal storage volume and a closed position for storing the gaming controller in the internal storage volume;

a handle attached to the body, the handle adapted for carrying the carrying case; and a stand integrated into a top surface of the body, wherein the stand has a stowed position in which a magnet temporarily holds the stand in a position flat on the top surface of the body, wherein the stand is alternately extendable up from the stowed position to a use position adapted for holding the smartphone on the top surface of the body at a viewing angle between 30 degrees and 80 degrees relative to the top surface of the body of the carrying case, wherein the stand comprises three hingedly attached rigid panels, wherein the first rigid panel is attached to a first edge of the second rigid panel with a first living hinge and the third rigid panel is attached to a second edge of the second rigid panel with a second living hinge, wherein the first edge is opposite the second edge, and wherein the first rigid panel is hingedly attached to body of the carrying case and the third rigid panel is also hingedly attached to the body of the carrying case.

11. The carrying case of claim 10 wherein the magnet also temporarily holds the stand in the stowed position.

12. The carrying case of claim 11 wherein the stand includes the magnet and the body includes a first metallic plate and a second metallic plate, and wherein the magnet is adapted to attract the first metallic plate to hold the stand in the stowed position and adapted to attract the second metallic plate to hold the stand in the use position.

13. The carrying case of claim 10 wherein, in the stowed position, the second rigid panel and the third rigid panel are in a first plane and the first rigid panel is folded under the second rigid panel in a second plane that is parallel to the first plane.

14. The carrying case of claim 13 wherein the first rigid panel is adapted to pivot approximately 180 degrees to transition the stand from the stowed position to the use position, wherein the second rigid panel and the third rigid panel form a triangle with the body when the stand is in the use position.

15. The carrying case of claim 10 wherein the body includes a zipper for selectively accessing the internal storage volume.

16. The carrying case of claim 10 wherein the body includes an internal accessory pocket adapted for holding an accessory associated with the gaming controller.

* * * * *